US010209019B2

(12) United States Patent
Dechant

(10) Patent No.: US 10,209,019 B2
(45) Date of Patent: Feb. 19, 2019

(54) PISTOL

(71) Applicant: Glock Technology GmbH, Deutsch Wagram (AT)

(72) Inventor: Friedrich Dechant, Hollabrunn (AT)

(73) Assignee: Glock Technology GmbH, Deutsch Wagram (AT)

( * ) Notice: Subject to any disclaimer, the term of this patent is extended or adjusted under 35 U.S.C. 154(b) by 0 days.

(21) Appl. No.: 15/907,228

(22) Filed: Feb. 27, 2018

(65) Prior Publication Data

US 2018/0245868 A1 Aug. 30, 2018

(30) Foreign Application Priority Data

Feb. 27, 2017 (EP) ..... 17158175

(51) Int. Cl.

| | |
|---|---|
| ***F41C 7/00*** | (2006.01) |
| ***F41A 11/00*** | (2006.01) |
| ***F41A 3/64*** | (2006.01) |
| *F41A 3/28* | (2006.01) |
| *F41A 5/06* | (2006.01) |
| *F41A 17/64* | (2006.01) |

(52) U.S. Cl.
CPC ..... *F41A 11/00* (2013.01); *F41A 3/64* (2013.01); *F41A 3/28* (2013.01); *F41A 5/06* (2013.01); *F41A 17/64* (2013.01)

(58) Field of Classification Search
CPC ..... F41A 11/00
See application file for complete search history.

(56) References Cited

U.S. PATENT DOCUMENTS

| | | | |
|---|---|---|---|
| 1,427,966 | A | 9/1922 | Nickl |
| 1,637,400 | A | 8/1927 | Kiraly et al. |
| 2,107,359 | A | 2/1938 | Altenburger |
| 2,817,174 | A | 12/1957 | Liedke |
| 3,728,939 | A | 4/1973 | Wilhelm |
| 3,745,881 | A | 7/1973 | Roy |

(Continued)

FOREIGN PATENT DOCUMENTS

| | | | | |
|---|---|---|---|---|
| DE | 405424 C | * | 11/1924 | ..... F41A 3/64 |
| DE | 459454 | | 5/1928 | |

(Continued)

OTHER PUBLICATIONS

Beretta PX4 Storm review on YouTube at https://youtu.be/wrd2mjVFNoM, published Sep. 13, 2015.

(Continued)

*Primary Examiner* — Gabriel J. Klein
(74) *Attorney, Agent, or Firm* — Kolisch Hartwell, P.C.

(57) ABSTRACT

A pistol with a frame, including a trigger mechanism and a movable slide, in which a barrel, a recoil spring, and a firing mechanism comprising a firing pin are located. The firing pin is movably mounted in a firing pin guide, where the firing pin guide has a holding plate on the end, which is pivoted in a holding notch in the slide, the slide being affixed in one angle of rotation of the holding plate and not in one other angle of rotation, and that the holding plate has a stop retainer, which abuts against a stop level in the frame and prevents the firing pin guide (spacer sleeve) and the firing pin from moving forward with the slide when the slide is removed from the frame.

10 Claims, 7 Drawing Sheets

(56) References Cited

U.S. PATENT DOCUMENTS

| | | | | |
|---|---|---|---|---|
| 4,539,889 | A | 9/1985 | Glock | |
| 4,825,744 | A | 5/1989 | Glock | |
| 4,893,546 | A | 1/1990 | Glock | |
| 4,984,504 | A | 1/1991 | Beretta | |
| 5,024,139 | A | 6/1991 | Knight, Jr. et al. | |
| 5,050,481 | A | 9/1991 | Knight, Jr. et al. | |
| 5,585,589 | A | 12/1996 | Leiter | |
| 5,649,383 | A | 7/1997 | Wesp et al. | |
| 6,234,059 | B1 | 5/2001 | Fuchs et al. | |
| 6,314,859 | B1 | 11/2001 | Weichert et al. | |
| 6,865,979 | B1 * | 3/2005 | Vaid | F41A 17/72 42/90 |
| 7,103,998 | B2 | 9/2006 | McGarry | |
| 7,823,314 | B1 | 11/2010 | Wheatley | |
| 8,061,255 | B1 | 11/2011 | Boberg | |
| 8,413,363 | B1 * | 4/2013 | Karfiol | F41A 11/00 42/106 |
| 8,807,010 | B2 | 8/2014 | Bubits | |
| 8,950,100 | B2 | 2/2015 | Nebeker et al. | |
| 9,285,186 | B1 * | 3/2016 | Di Veroli | F41G 1/06 |
| 9,568,262 | B2 | 2/2017 | Bantle et al. | |
| 9,664,471 | B1 * | 5/2017 | Curry | F41A 19/30 |
| 9,891,014 | B2 * | 2/2018 | Dechant | F41A 11/00 |
| 2009/0199450 | A1 | 8/2009 | Storch | |
| 2010/0275491 | A1 | 11/2010 | Leiter et al. | |
| 2012/0085225 | A1 | 4/2012 | Vanek | |
| 2014/0196337 | A1 | 7/2014 | Bandini et al. | |
| 2016/0316336 | A1 | 10/2016 | Krenz et al. | |
| 2017/0191784 | A1 | 7/2017 | Kroyer | |
| 2017/0198993 | A1 | 7/2017 | Dechant | |
| 2017/0211901 | A1 * | 7/2017 | Keller | F41A 3/66 |
| 2018/0112945 | A1 * | 4/2018 | Sroufe | F41A 19/30 |

FOREIGN PATENT DOCUMENTS

| | | | | |
|---|---|---|---|---|
| DE | 478630 | | 6/1929 | |
| EP | 0359715 | A2 | 3/1990 | |
| EP | 2784431 | A1 | 10/2014 | |
| FR | 746237 | A * | 5/1933 | F41A 11/00 |
| GB | 510898 | A * | 8/1939 | F41A 3/64 |
| WO | WO-2015050606 | A2 * | 4/2015 | F41A 3/58 |

OTHER PUBLICATIONS

Grand Power X-Calibur—Competition Ready 9mm review on YouTube at https://youtu.be/DOvDmZVOunM, published Oct. 8, 2015.

European Patent Office, "Extended European Search Report" in connection with related European Patent Application No. 17158175.4, dated Aug. 16, 2017, 7 pgs.

* cited by examiner

PISTOL

TECHNICAL FIELD

The invention concerns a pistol with a frame and slide and in particular the detachable combination of the frame and slide corresponding to the generic concept of claim 1.

BACKGROUND

U.S. Pat. No. 5,024,139 (Knight) discloses a semi-automatic, double action only pistol with a rotating barrel that is disassembled upon the removal of the magazine and the manipulation of a lever located on the frame by turning the lever 90°. This rotation brings a notch out of the way of a barrel lug thus allowing the slide to move forward until it disengages from its guides on the frame. The pistol according to U.S. Pat. No. 4,984,504 (Beretta) also uses a lever located on the frame for disassembly.

U.S. Pat. No. 1,427,966 (Nickl) discloses a similar rotating barrel pistol that is designed with a disassembly mechanism located in the frame. One of the main differences between Nickl and Knight/Beretta is that the disassembly mechanism in Nickl is a pin that must be pushed against a spring perpendicular to the symmetry plane of the pistol in order to allow the displacement of certain parts in the slide.

The content of the three mentioned documents is hereby incorporated by reference in their entireties for all purposes, and shall therefore become an integral part of this description for all jurisdictions in which this is possible.

SUMMARY

Disassembly of a pistol requires separating the slide from the frame of the pistol. While there are various approaches to disassembling pistols, the present invention's purpose is to provide an alternative takedown system based on a slide mount mechanism.

This object is accomplished according to the present invention by the characterizing part of claim 1, in other words, the slide mount is fitted on a component connected to the firing pin guide (spacer sleeve), so that the slide can be moved forward when the mount is released, while the firing pin and its carrier remain behind the trigger edge of the trigger bar in the frame. The mounting component together with the firing pin can either be removed from the slide or it can only be pushed back far enough in the slide, while being captive, if the slide is moved forward and is then removed from the frame together with the slide once the guides between the slide and the frame are no longer engaged.

With other words, all parts necessary for dismantling are concentrated on the slide and its parts. To say so, the invention relates to a pistol with a frame, in which there is a trigger mechanism and with a slide movable along guides in the frame which are preferably parallel to the axis of the barrel, in the slide a barrel, a recoil spring and a firing and holding mechanism are located, the latter comprises a firing pin, which is movably mounted in a firing pin guide (spacer sleeve), the pistol is characterized by the fact that, the mechanism for disassembling the slide from the frame is situated in the slide only.

Features, functions, and advantages may be achieved independently in various embodiments of the present disclosure, or may be combined in yet other embodiments, further details of which can be seen with reference to the following description and drawings.

DETAILED DESCRIPTION

In the description and the claims the terms "front", "back", "top", "bottom" etc. are used in the generally accepted form and with reference to a pistol, in the usual manner. This means that the muzzle of the barrel is at the "front", that the slide is displaced backwards by the explosive gases, etc. The description is based on a pistol with a rotating barrel; however the invention is not limited to the described and shown embodiments.

Figure 1:
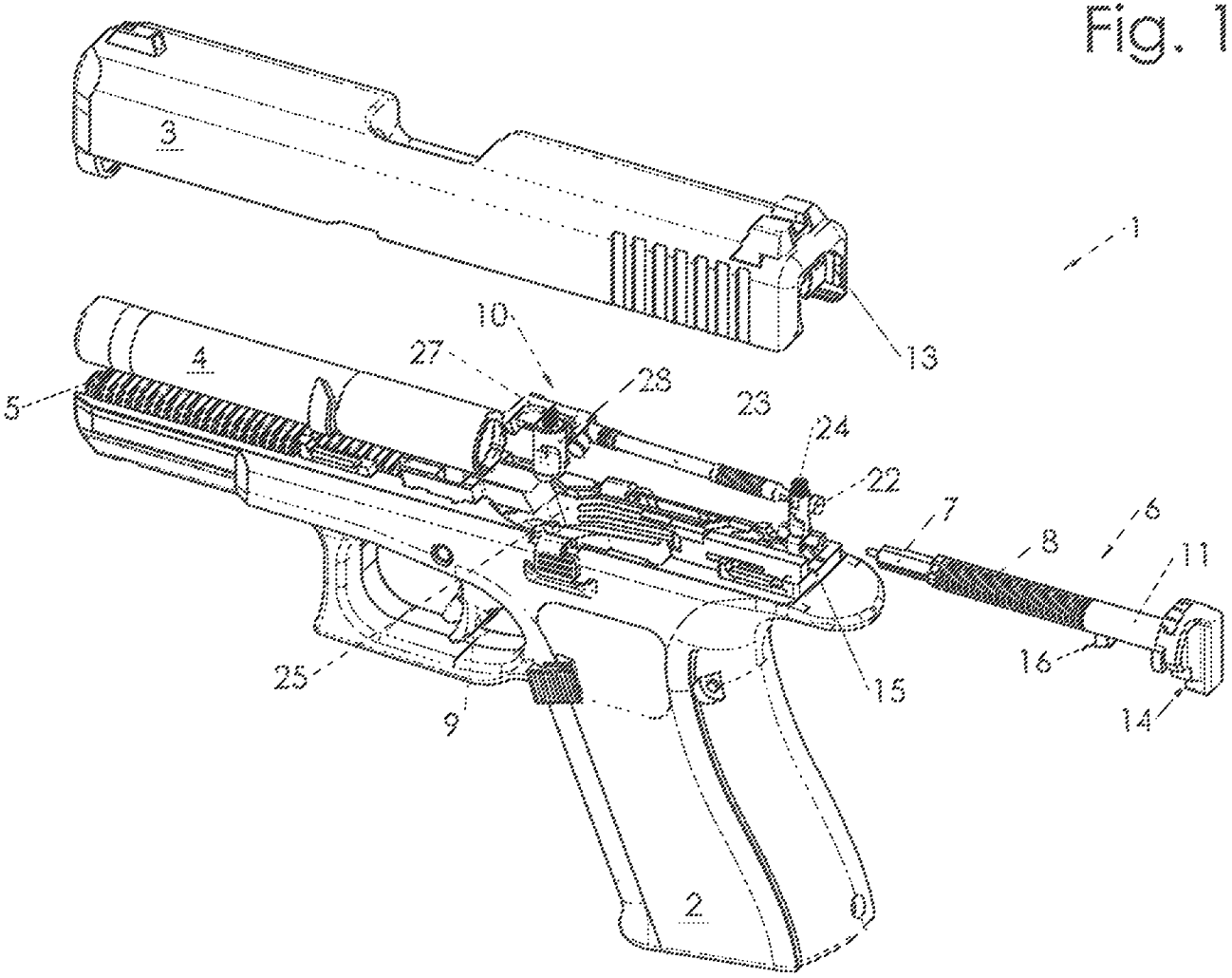
FIG. 1 depicts an exploded drawing of a pistol with a rotating barrel designed according to the present disclosure.

As can be seen in FIG. 1, a pistol 1 according to the invention has a frame 2 and a slide 3. The exploded drawing in FIG. 1 shows the barrel 4, the recoil spring 5 and the firing and holding mechanism 6 including the firing pin 7 and the firing pin spring 8 removed from the slide 3, for better clarity. The frame 2 contains a trigger mechanism referred to as a whole as 9 with a trigger bar 25, in slide 3 and a safety mechanism 10 which cooperates with the trigger mechanism 9.

The firing and holding mechanism 6 has a firing pin guide (spacer sleeve) 11, around which there is a pivoting holding plate 12, which is primarily normal to the axis of the firing pin 7 which protrudes to the outside. This holding plate 12 is, when mounted, retained in a holding notch 13 in the slide 3. At the bottom end, facing the frame 2, the holding plate 12 has a stop retainer 14, which in mounted condition, is held by the force of the recoil spring 5 on a surface, the stop level 15, of the frame 2 and prevents the slide 3 from being able to move any further forward than that.

Figure 2:
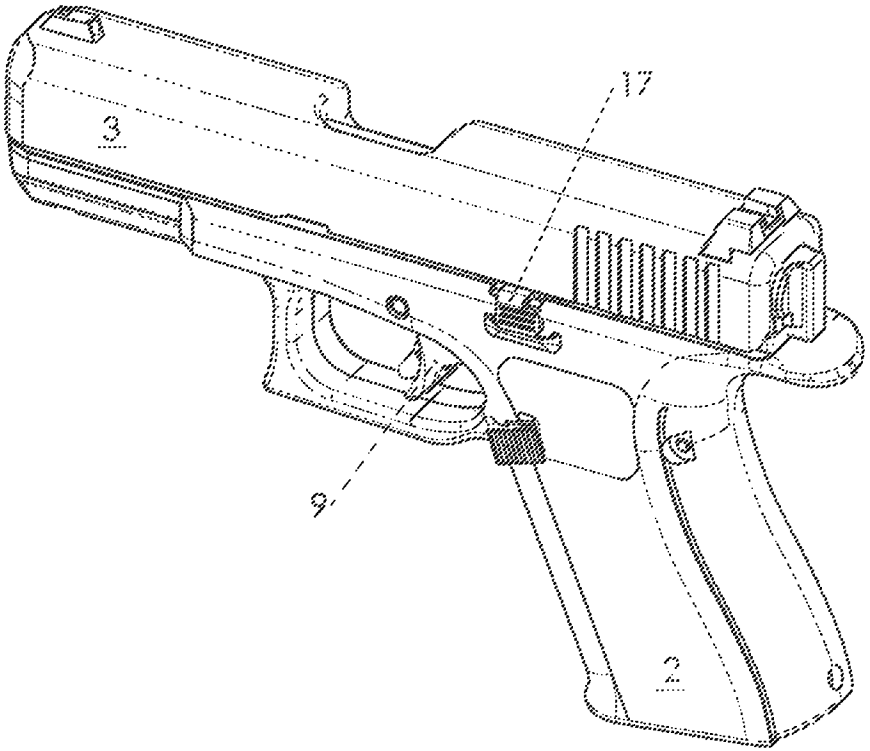
FIG. 2 depicts the pistol of FIG. 1 in the initial position before starting to dismantle it.

FIG. 2 shows the situation before starting to dismantle the pistol (after the magazine (not shown) has been removed from the frame 2).

Figure 3:
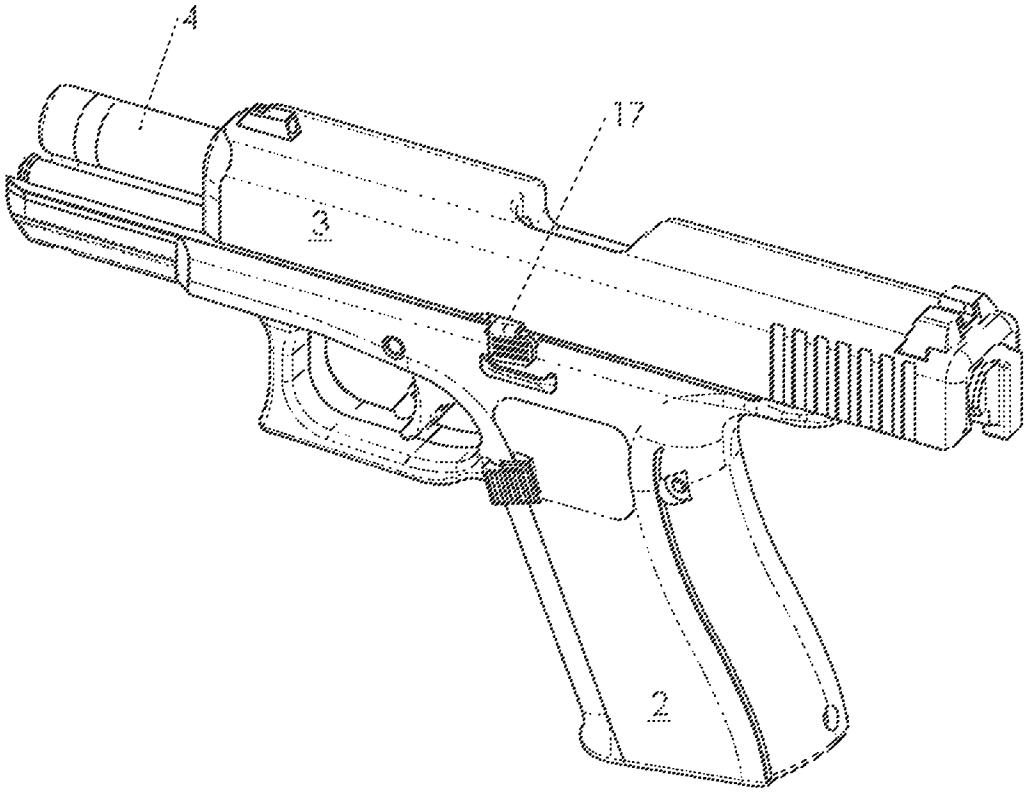
FIG. 3 depicts the situation with the slide pushed back and affixed before releasing the slide mount.

As shown in FIG. 3, the slide 3 is then manually pulled back against the force of the recoil spring 5, ejecting any cartridge that may be in the chamber. In the position of the slide 3 shown in FIG. 3 on the frame 2 it is possible to push a slide stop lever 17 up against the force of a spring not shown here, into a recess in the slide 3 and thus affix the slide in the position shown. During normal operation of the pistol, this slide stop lever 17 is moved into the position shown by the follower in the magazine (not shown) if the last shot in the magazine has been fired. The movement of the slide stop lever 17 latches the slide 3 against moving forward until the slide stop lever 17 is released. It is possible to chamber a new cartridge without the need to move the slide 3 manually by replacing the empty magazine with a new loaded magazine and then releasing the slide stop lever 17 while the slide 3 is locked in the rearward position. As soon as the slide stop lever 17 is released, the slide 3 is moved by the force of the recoil spring 5 forward and pushes the first cartridge of the new loaded magazine into the chamber of the barrel 4.

Figure 4:
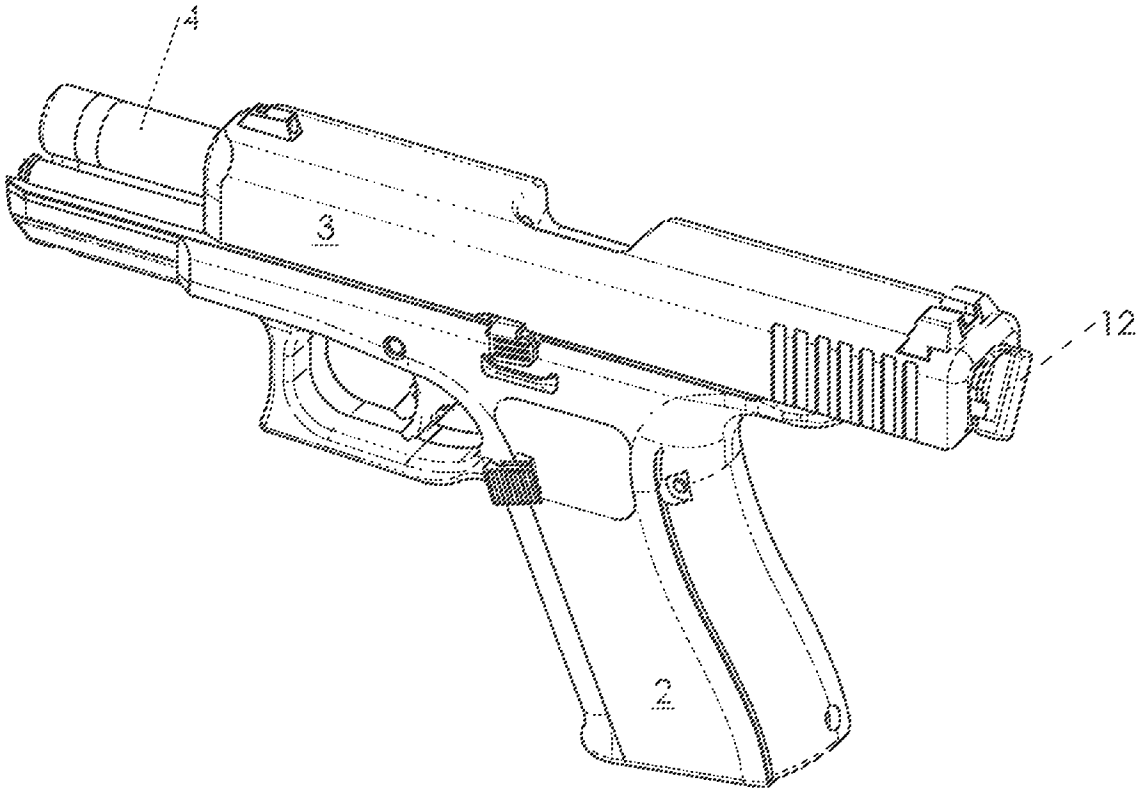
FIG. 4 depicts releasing the firing and holding mechanism.

When dismantling the pistol, it is then necessary to release the firing and holding mechanism 6, as shown in FIG. 4, by turning the holding plate 12 in its holding notch 13, which has the form of an undercut recess. This turning motion is facilitated by a rib, which also bears the stop retainer 14 in the design example shown. The rotation shown causes the locking lugs 26 on the holding plate 12 (FIG. 7) to protrude out of the undercut parts of the holding notch 13, making it possible to move the firing and holding mechanism 6 backwards towards the axis of the firing pin 7 aligned or parallel to the axis of the barrel in the position when the pistol is ready to fire (in battery) with regard to the rest of the slide.

Figure 5:
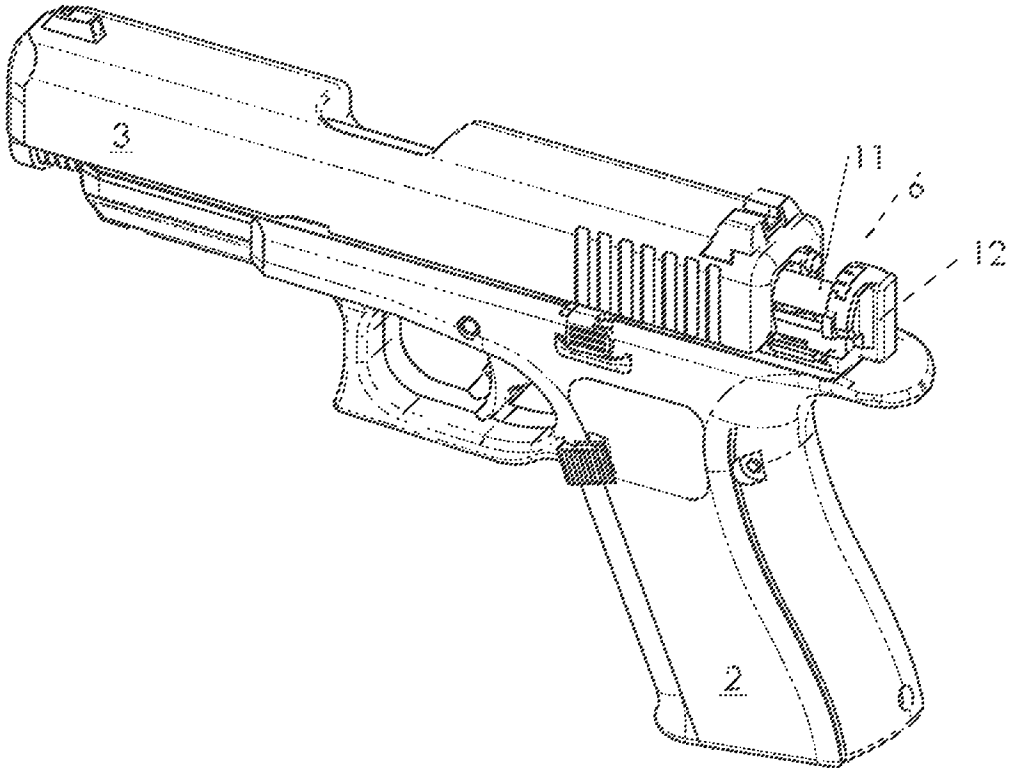
FIG. 5 depicts pushing the slide forwards, separating the firing and holding mechanism.

This is shown in FIG. 5: the slide 3 with the firing and holding mechanism 6 pushed back, is moved forwards until it is in a position in which it can be lifted out. This pushes the firing and holding mechanism 6 through a trigger edge of the trigger bar 25 over the carrier 16 of the firing pin 7 backwards out of the slide, with the firing and holding mechanism 6 being either completely or partially pushed out. In the latter case, a maximum displacement of the firing and holding mechanism 6 in relation to the slide 3 is limited by a plunger lock 24 and the firing pin guide (spacer sleeve) 11 caused by suitable corresponding surfaces (overview of FIG. 1 and FIG. 7). The forwardmost position of the slide 3, which allows it to be lifted out, is reached, at the latest, when the holding plate 12 of the firing and holding mechanism, which can now be pushed out, meets the stop level 15 in the frame 2.

Figure 6:
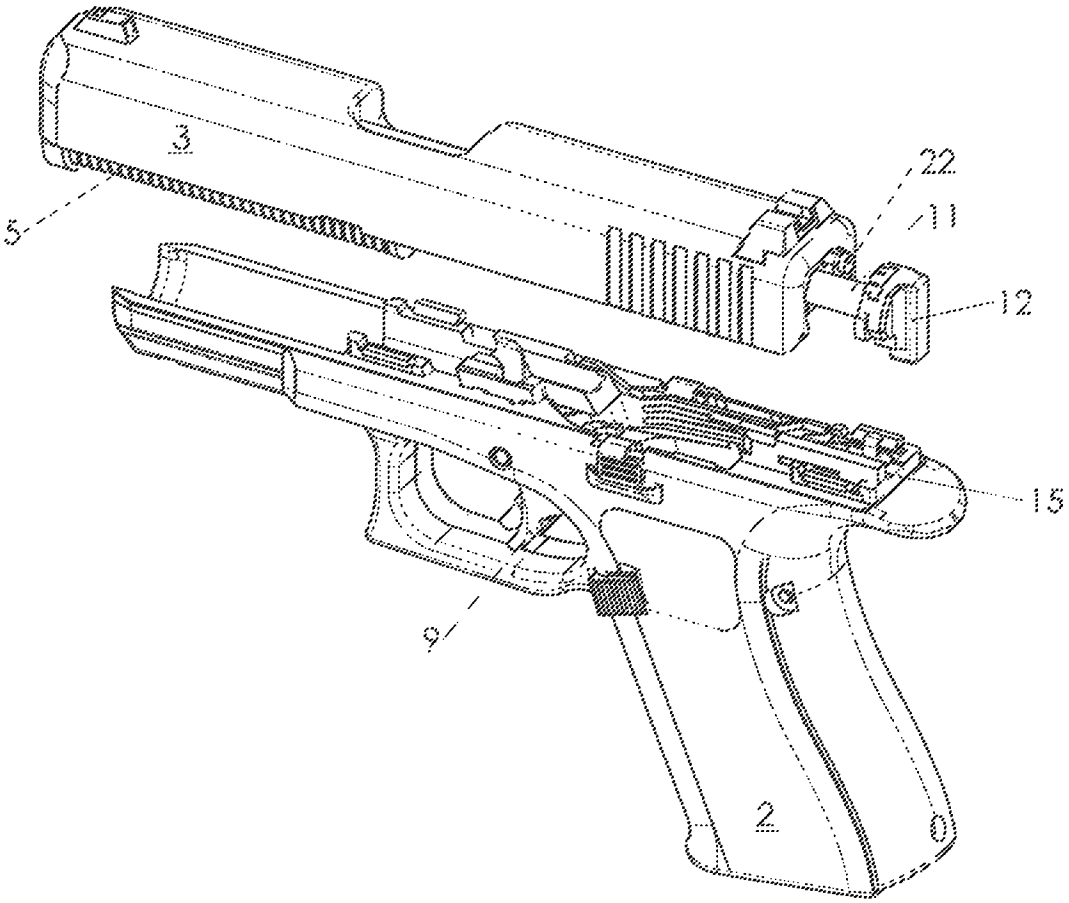
FIG. 6 depicts the situation with the slide removed.

FIG. 6 shows that if the guides or counterguides on the frame 2 and slide 3 are disengaged, the whole slide 3, including the firing and holding mechanism 6 can be removed from the frame 2 and the two basic components of the pistol are separated.

Figure 7:
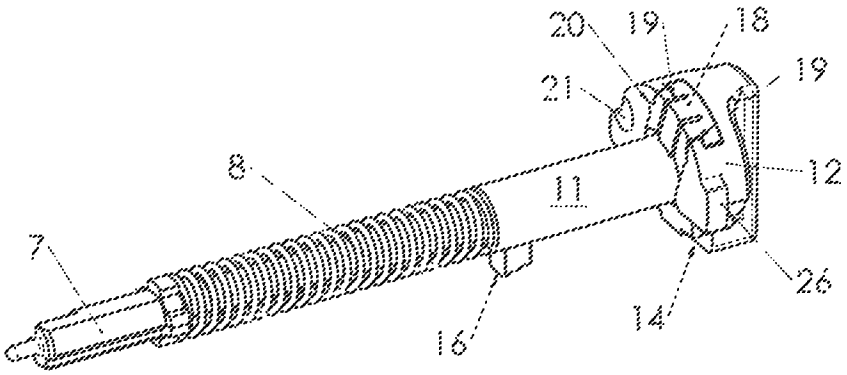
FIG. 7 depicts the firing and holding mechanism.

FIG. 7 shows the firing and holding mechanism 6 in greater detail. The holding plate 12 is rotatably mounted on the firing pin guide (spacer sleeve) 11 in an undercut guide, similar to the bearing of the holding plate 12 in the holding notch 13 (FIG. 1), which has the form of an undercut guide, too, in the slide 3. For appropriate fixation in a radial direction relative to the axis of the firing pin 7 there is a slide cover lock 18, which is pushed into the undercut notch 21 in a radial direction after the firing pin guide (spacer sleeve) 11 is inserted. This slide cover lock 18 has two cuts 19 in an almost radial direction, as a result of which the outer, tongue-shaped parts of the slide cover lock 18, act as springs. As indicated by arrow 20, they have bulges relative to the cuts 19, which correlate to notches in the holding plate 12 in this region and thus hold the slide cover lock 18 in the holding plate 12 by means of locking retention, even if the whole firing and holding mechanism 6 is not mounted in the slide 3, where this holding mechanism provides positive closure. Such a fixation of the slide cover lock 18 can also be facilitated by the elastic interaction of a convex protrusion on the back of the same component with a corresponding recess in the holding plate 12.

It can also be seen in FIG. 7 that there is a notch 21 in an axial direction in the front surface of the holding plate 12. A spring-loaded depressure plunger bearing 22 (FIG. 5), or its front surface, interacts with this notch 21. The interaction of the front surface of the depressure plunger bearing 22 with the notch 21 secures the angular position of the holding plate 12 by means locking retention, thus preventing accidental turning and thus release, while allowing it to be turned by hand if adequate force (torque) is exerted, for the pistol to be dismantled.

A plunger lock 24 (FIG. 1) has a dual function: on the one hand it limits the axial motion of the firing and holding mechanism 6, while on the other hand it prevents the extractor group 27 and the safety mechanism 10, including the firing pin safety 28, from falling out of the slide 3. Where necessary, the axial movement of the firing and holding mechanism 6 by the plunger lock 24 by a surface perpendicular to the direction of movement of the plunger lock 24 is aligned with a corresponding surface on the firing pin guide (spacer sleeve) 11. The plunger lock 24 prevents the safety mechanism 10 and the extractor group 27 from falling out by a recess in the plunger lock 24 engaging in a groove the depressure plunger bearing 22, so that the latter only has limited freedom of movement.

Further dismantling is then possible by pushing the plunger lock 24 from the underside of the slide 3 against the spring force, if necessary by way of the interaction of the plunger lock 24 with the depressure plunger bearing 22, so far that the firing and holding mechanism 6, in accordance with the bulge in the plunger lock 24, to move out of that area so that it can be removed from the slide 3. In the same way, the extractor group 27 and the safety mechanism 10 can also be dismantled or removed from the slide 3.

As is immediately evident, the three functional assemblies:

a) The safety mechanism 10,
b) Extractor group 27, and
c) The depressure plunger bearing 22 and the plunger lock 24 for the firing and holding mechanism 6 essentially need only a longitudinal bore in the slide 3 and aligned bars or rods, which are brought into the correct position using compression springs and stops (not shown), from which they can easily be removed to dismantle the pistol.

Due to the invention's combination of features it is also possible to, irrespective of the movement of the slide 3, to separate the firing and holding mechanism 6 on the one hand and the trigger mechanism 9 on the other hand, which has not been possible until now.

LIST OF REFERENCE SIGNS

1. Pistol
2. Frame
3. Slide
4. Barrel
5. Recoil spring
6. Firing and holding mechanism
7. Firing pin
8. Firing pin spring
9. Trigger mechanism
10. Safety mechanism
11. Firing pin guide (spacer sleeve)
12. Holding plate
13. Holding notch
14. Stop retainer
15. stop level
16. Carrier
17. Slide stop lever
18. Slide cover lock
19. Cuts
20. Arrow
21. Notch
22. Depressure plunger bearing

23. Depressure plunger
24. Plunger lock
25. Trigger bar
26. Locking lugs
27. Extractor group
28. Firing pin safety Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

The invention claimed is:

1. A pistol, comprising:

a frame, including a trigger mechanism;

a slide that is movable along one or more guides in the frame, wherein the slide includes a barrel having a longitudinal axis, a recoil spring, and a firing and holding mechanism;

wherein the firing and holding mechanism includes a firing pin that is movably mounted within a firing pin guide;

wherein the firing pin guide includes a holding plate disposed on an end of the firing pin guide that is opposite from a tip of the firing pin;

wherein the holding plate is pivotable upon the firing pin guide and can be pivoted while disposed within a U-shaped holding notch formed in the slide, where the holding plate pivot axis is parallel to the longitudinal axis of the barrel; and wherein the holding plate includes a stop retainer that is configured to contact a stop level on the frame when the slide is moved forwardly to prevent the slide from moving further forwards;

provided that when the holding plate is pivoted within the holding notch to a first angle of rotation the firing and holding mechanism is affixed to the slide, and when the holding plate is pivoted within the holding notch to a second angle of rotation the holding plate, firing pin guide, and the firing pin are separated from the slide, so that when the slide is subsequently moved forwardly the stop retainer contacts the stop level and prevents the firing and holding mechanism from moving further forward.

2. The pistol of claim 1, wherein the pistol is configured so that after the stop retainer of the firing and holding mechanism contacts the stop level, moving the slide further forward disengages the slide from the guides in the frame and permits the slide to be removed from the frame.

3. The pistol of claim 1, wherein the slide is movable along the one or more guides in the frame along a path that is substantially parallel to the longitudinal axis of the barrel.

4. The pistol of claim 1, wherein when the holding plate is pivoted to the second angle of rotation, the holding plate, firing pin guide, and the firing pin can be moved rearwardly in the slide to a degree that is determined by an interaction of a plunger lock with a flattened portion of the outer surface of the firing pin guide.

5. The pistol of claim 1, wherein the holding plate includes a surface facing the slide that includes a u-shaped notch, wherein the u-shaped notch is configured to cooperatively engage with a spring-loaded depressure plunger bearing to releasably secure the holding plate in the first angle of rotation.

6. The pistol of claim 1, wherein the firing pin guide is rotatably connected to the holding plate by the interaction of a flange on the firing pin guide with a u-shaped notch in the holding plate, and wherein the firing pin guide is retained within the u-shaped notch by a radially mounted slide cover lock that is secured in position by an elastic deformation of one of its parts or cuts in the holding plate.

7. The pistol of claim 1, further comprising:

an extractor group having a spring guide;

one or more holding parts for the firing and holding mechanism; and one or more locking lugs on the holding plate that are configured to retain the holding plate in the u-shaped notch of the slide when it is in the first angle of rotation;

wherein the holding parts for the firing and holding mechanism are operatively connected to the spring guide for the extractor group.

8. The pistol of claim 7, wherein the spring guide for the extractor group, the depressure plunger, and the depressure plunger bearing, and any associated coil springs are arranged in a single bore in the slide.

9. The pistol of claim 1, wherein the firing pin guide includes a spacer sleeve.

10. The pistol of claim 1, wherein the pistol employs a rotating barrel.

* * * * *